US008434189B2

(12) United States Patent
Wang

(10) Patent No.: US 8,434,189 B2
(45) Date of Patent: May 7, 2013

(54) BRUSH HAVING A RESILIENTLY ARTICULATED HANDGRIP

(76) Inventor: Huo-Pia Wang, Chang-Hua (TW)

( * ) Notice: Subject to any disclaimer, the term of this patent is extended or adjusted under 35 U.S.C. 154(b) by 581 days.

(21) Appl. No.: 12/624,880

(22) Filed: Nov. 24, 2009

(65) Prior Publication Data

US 2011/0119849 A1 May 26, 2011

(51) Int. Cl.
*A46B 7/02* (2006.01)

(52) U.S. Cl.
USPC ..... 15/172; 15/144.1

(58) Field of Classification Search ..... 15/144.1, 15/172
See application file for complete search history.

(56) References Cited

U.S. PATENT DOCUMENTS 3,473,183 A * 10/1969 Burns et al. ..... 15/144.1
3,964,121 A * 6/1976 Kim ..... 15/115
5,657,507 A * 8/1997 Wasak ..... 15/220.1

* cited by examiner

*Primary Examiner* — Randall Chin
(74) *Attorney, Agent, or Firm* — Hunton & Williams LLP

(57) ABSTRACT

A brush includes: a brushing unit including a bristle-retaining member that has a first side and a second side opposite to the first side, a plurality of bristles retained on the bristle-retaining member and disposed on the first side, and a pivot connector provided on the second side of the bristle-retaining member; a handgrip having a pivoted portion that is pivotally connected to the pivot connector, a grip portion that is opposite to the pivoted portion, and a positioning portion that is disposed between the pivoted portion and the grip portion; and a resilient component disposed between the brushing unit and the handgrip, and providing a biasing force for urging the positioning portion of the handgrip to abut against the bristle-retaining member.

11 Claims, 12 Drawing Sheets

BRUSH HAVING A RESILIENTLY ARTICULATED HANDGRIP

BACKGROUND OF THE INVENTION

1. Field of the Invention

This invention relates to a brush, more particularly to a brush having a resiliently articulated handgrip.

2. Description of the Related Art

Referring to FIG. 1, a conventional pet brush comprises a brushing unit 1 including a plurality of bristles 101, and a handgrip 2 disposed fixedly on the brushing unit 1.

Since the handgrip 2 is disposed fixedly on the brushing unit 1, adjustments in operating posture and movement are required in order to position the pet brush so that the bristles 101 of the brushing unit 1 remain effectively positioned for brushing when the bristles 101 are passed along curvatures of a pet's body. Therefore, operation of the conventional pet brush is inconvenient.

SUMMARY OF THE INVENTION

Therefore, an object of the present invention is to provide a brush having a resiliently articulated handgrip capable of pivoting in response to variations in operating conditions.

According to the present invention, there is provided a brush comprising a brushing unit, a handgrip, and a resilient component. The brushing unit includes a bristle-retaining member that has a first side and a second side opposite to the first side, a plurality of bristles retained on the bristle-retaining member and disposed on the first side, and a pivot connector provided on the second side of the bristle-retaining member. The handgrip has a pivoted portion that is pivotally connected to the pivot connector, a grip portion that is opposite to the pivoted portion, and a positioning portion that is disposed between the pivoted portion and the grip portion. The resilient component is disposed between the brushing unit and the handgrip, and provides a biasing force for urging the positioning portion of the handgrip to abut against the bristle-retaining member.

The advantage of the present invention resides in providing a brush with a resiliently articulated handgrip capable of pivoting relative to a brushing unit thereof when bristles of the brushing unit are passed along curvatures of a pet's body such that the bristles remain effectively positioned for brushing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
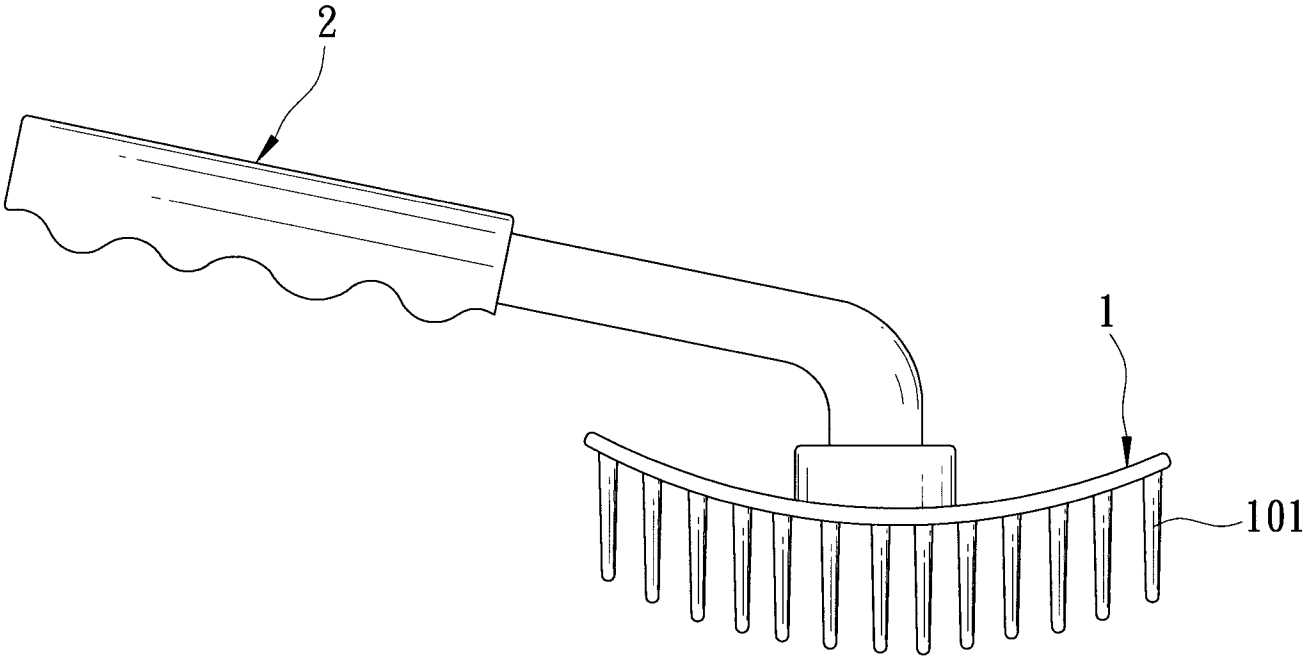
FIG. 1 PRIOR ART
FIG. 1 is a schematic diagram of a conventional brush.
Figure 2:
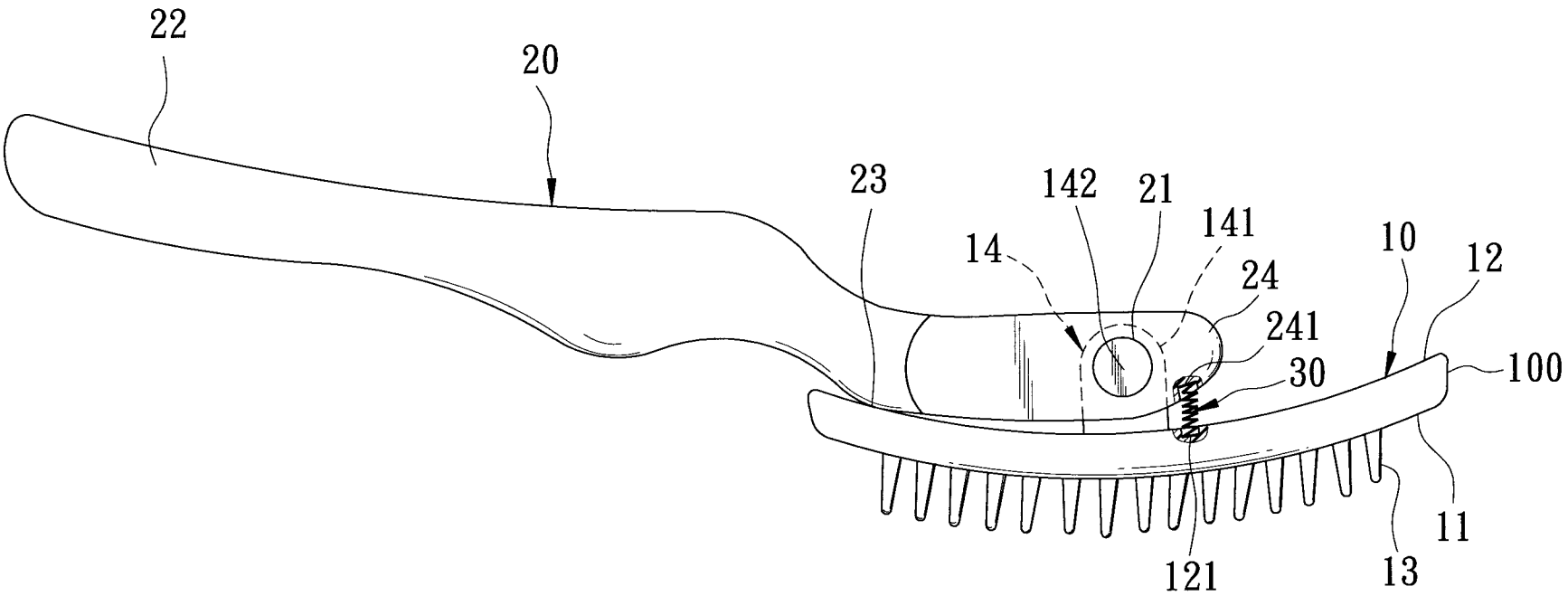
FIG. 2 is a schematic diagram of a first preferred embodiment of a brush having a resiliently articulated handgrip according to the present invention.

FIG. 2 illustrates a first preferred embodiment of the brush having a resiliently articulated handgrip according to the present invention. The brush comprises a brushing unit 10, a handgrip 20, and a resilient component 30. In this embodiment, the brush is used for brushing pet hair.

The brushing unit 10 includes a bristle-retaining member 100 that has a first side 11 and a second side 12 opposite to the first side 11, a plurality of bristles 13 retained on the bristle-retaining member 100 and disposed on the first side 11, and a pivot connector 14 provided on the second side 12 of the bristle-retaining member 100. In this embodiment, the pivot connector 14 includes a pivot ear 141 projecting from the second side 12, and a pivot shaft 142 connected to the pivot ear 141. Preferably, the second side 12 has a lower engaging groove 121 adjacent to the pivot connector 14.

The handgrip 20 has a pivoted portion 21 that is pivotally connected to the pivot connector 14, a grip portion 22 that is opposite to the pivoted portion 21, and a positioning portion 23 that is disposed between the pivoted portion 21 and the grip portion 22. In this embodiment, the pivoted portion 21 of the handgrip 20 has a tip segment 24 distal from the positioning portion 23. Preferably, the tip segment 24 is formed with an upper engaging groove 241 opposite to the lower engaging groove 121 of the second side 12 of the bristle-retaining member 100. The pivoted portion 21 of the handgrip 20 is formed with a pivot hole through which the pivot shaft 142 is extended.

The resilient component 30 is disposed between the brushing unit 10 and the handgrip 20, and provides a biasing force for urging the positioning portion 23 of the handgrip 20 to abut against the bristle-retaining member 100. In this embodiment, the resilient component 30 is a compression spring having opposite ends that extend respectively into the lower engaging groove 121 of the second side 12 of the bristle-retaining member 100 and the upper engaging groove 241 of the tip segment 24 of the handgrip 20.

Figure 3:
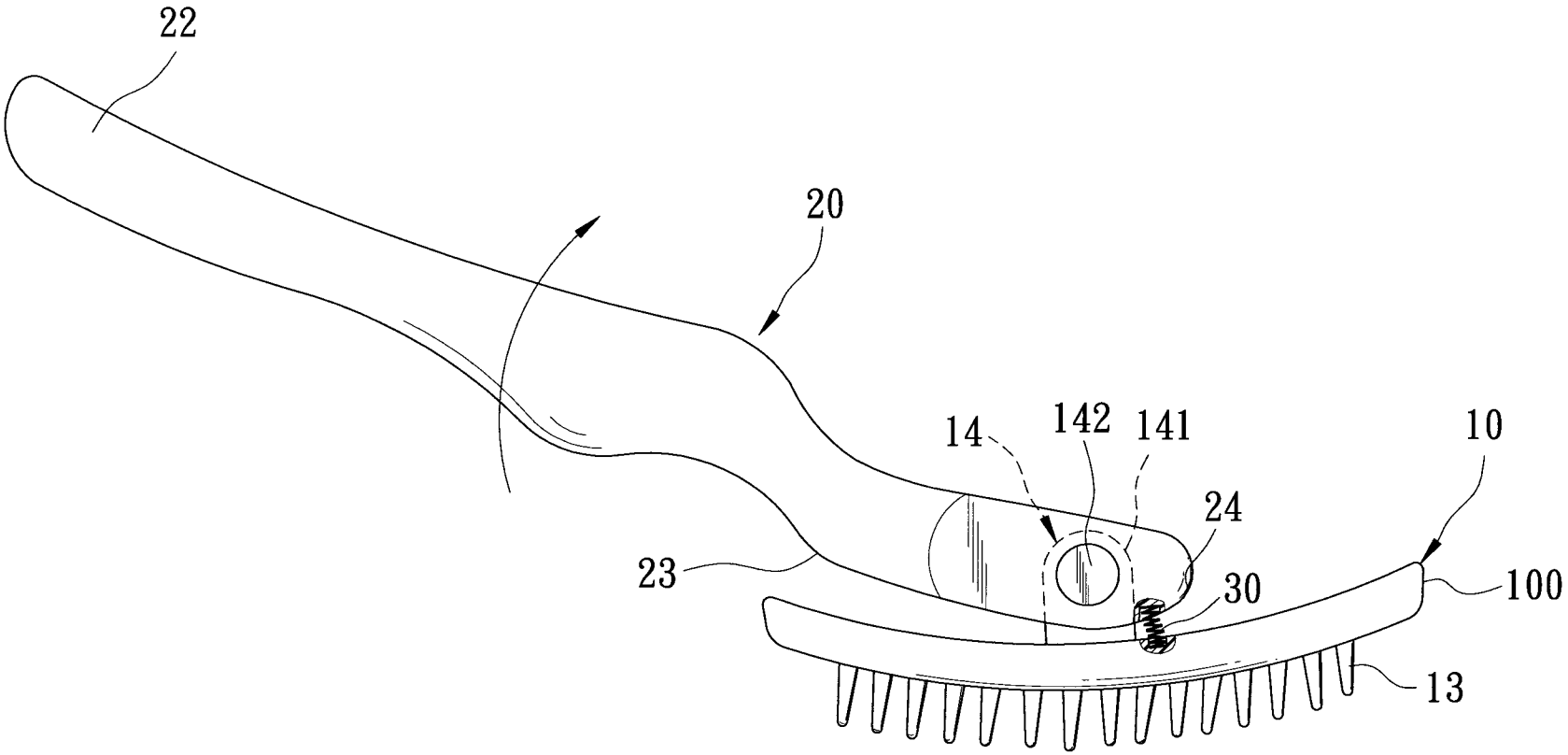
FIG. 3 is a schematic diagram to illustrate pivoting of a handgrip of the first preferred embodiment relative to a brushing unit thereof during operation.

Under normal conditions, the resilient component 30 abuts resiliently against the second side 12 of the bristle-retaining member 100 and the tip segment 24 of the handgrip 20 so as to provide the biasing force for urging the positioning portion 23 of the handgrip 20 to abut against the bristle-retaining member 100, thus maintaining an orientation of the bristle-retaining member 100. As shown in FIG. 3, when a user grips the grip portion 22 of the handgrip 20 and uses the bristles 13 to brush pet hair, the handgrip 20 pivots relative to the bristle-retaining member 100 as the bristles 13 are passed along curvatures of a pet's body such that the bristles 13 remain effectively positioned for brushing. As a result, brushing is comparatively easier and ergonomic. When the handgrip 20 pivots away from the bristle-retaining member 100 of the brushing unit 10, the positioning portion 23 separates from the bristle-retaining member 100, and the resilient component 30 is compressed. On the other hand, when the user eases pressure on the handgrip 20, the biasing force provided by the resilient component 30 urges the positioning portion 23 of the handgrip 20 to abut against the bristle-retaining member 100 of the brushing unit 10 as shown in FIG. 2.

Figure 4:
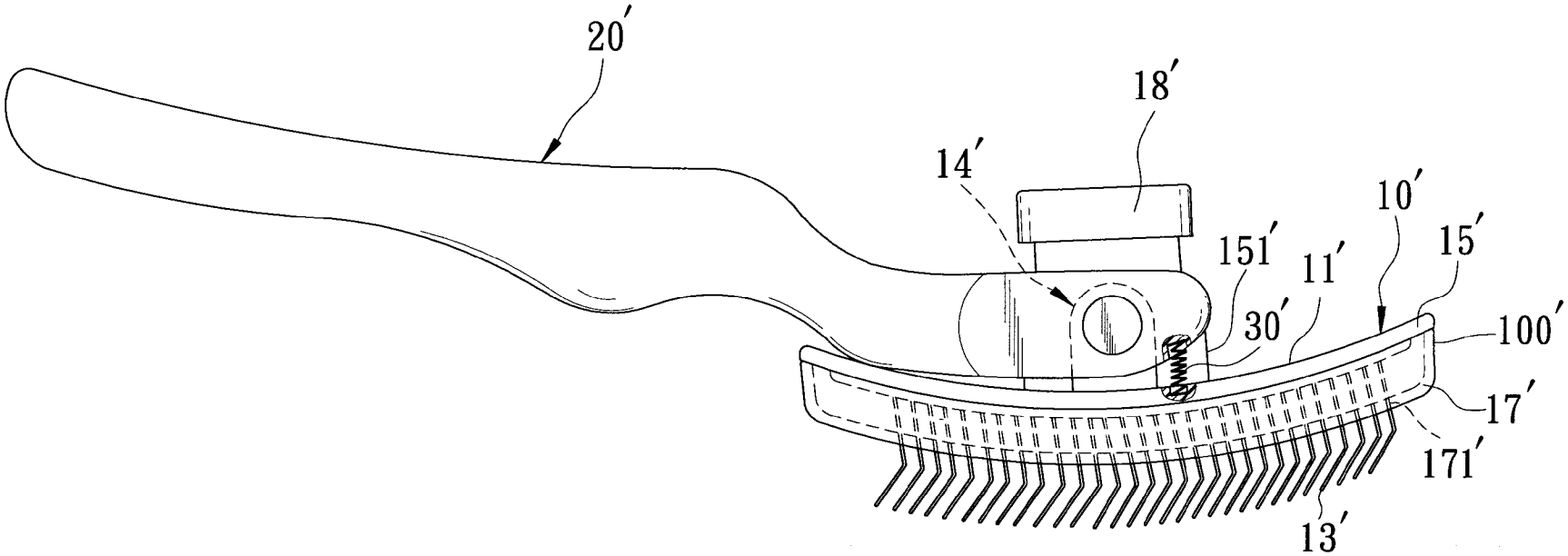
FIG. 4 is a schematic diagram of a second preferred embodiment of a brush having a resiliently articulated handgrip according to the present invention.
Figure 5:
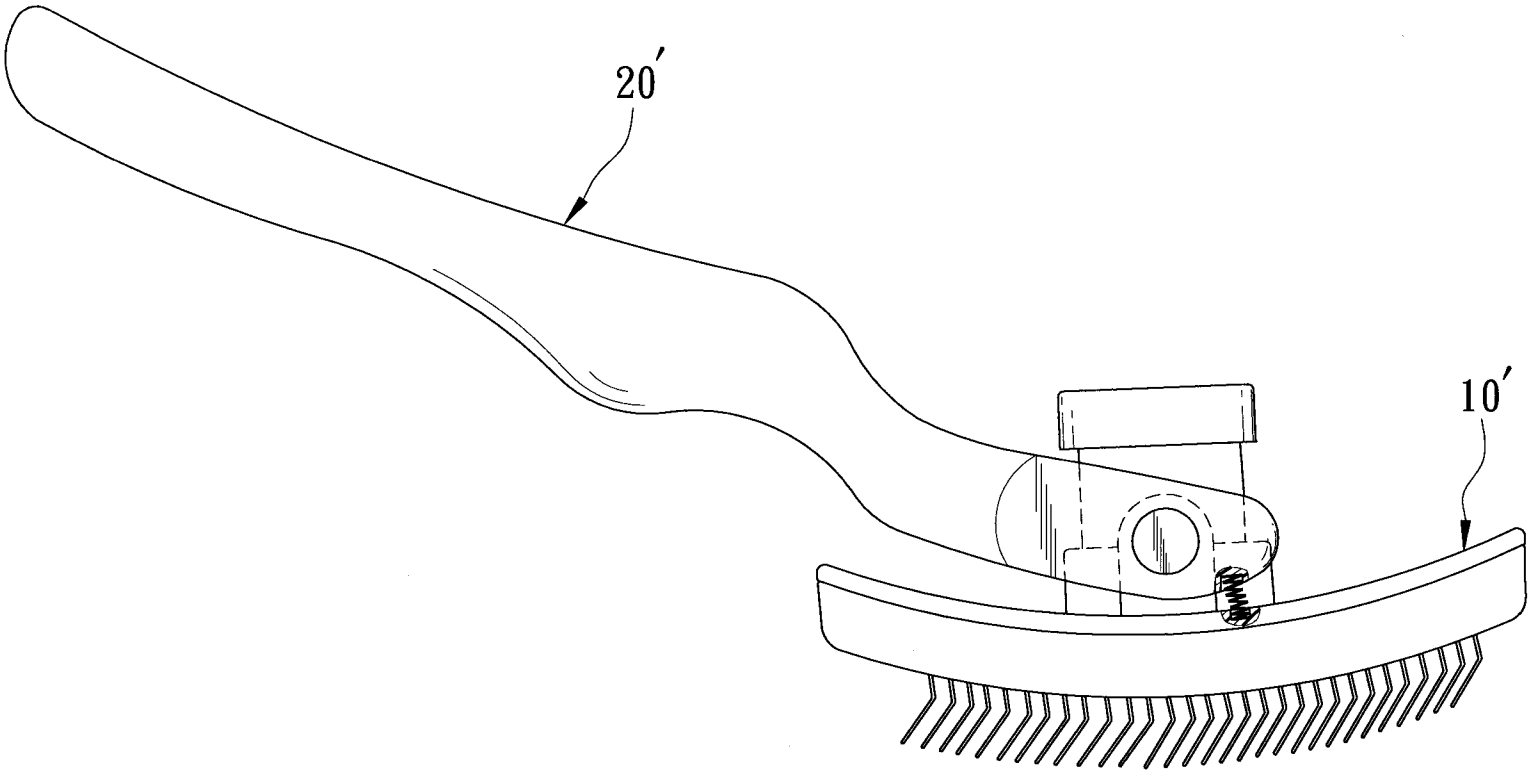
FIG. 5 is a schematic diagram to illustrate pivoting of a handgrip of the second preferred embodiment relative to a brushing unit thereof during operation.

FIG. 4 illustrates a second preferred embodiment of the brush having a resiliently articulated handgrip according to the present invention. The brush comprises a brushing unit 10', a handgrip 20' and a resilient component 30'. The difference between the second preferred embodiment and the first preferred embodiment resides in that the brushing unit 10' of the second preferred embodiment has a brush cleaning function, and to support this function, the bristle-retaining member 100' includes a bristle-retaining wall 15' having the bristles 13' retained thereat, a strand-removing wall 17', and an operating member 18'. The brushing unit 10' has amounting seat 151' disposed on the first side 11' of the bristle-retaining member 100' and proximate to the pivot connector 14'. The strand-removing wall 17' is movable toward and away from the bristle-retaining wall 15' and is formed with a plurality of bristle-extension apertures 171' through which the bristles 13' extend. The operating member 18' is disposed in the mounting seat 151' and is connected to the strand-removing wall 17' for driving movement of the strand-removing wall 17' relative to the bristle-retaining wall 15'. Operating the operating member 18' moves the strand-removing wall 17' away from the bristle-retaining wall 15' so as to remove pet hair (not shown) that has accumulated around the bristles 13', thus facilitating cleaning of the brush. The handgrip 20' can also pivot relative to the brushing unit 10' as shown in FIG. 5.

Figure 6:
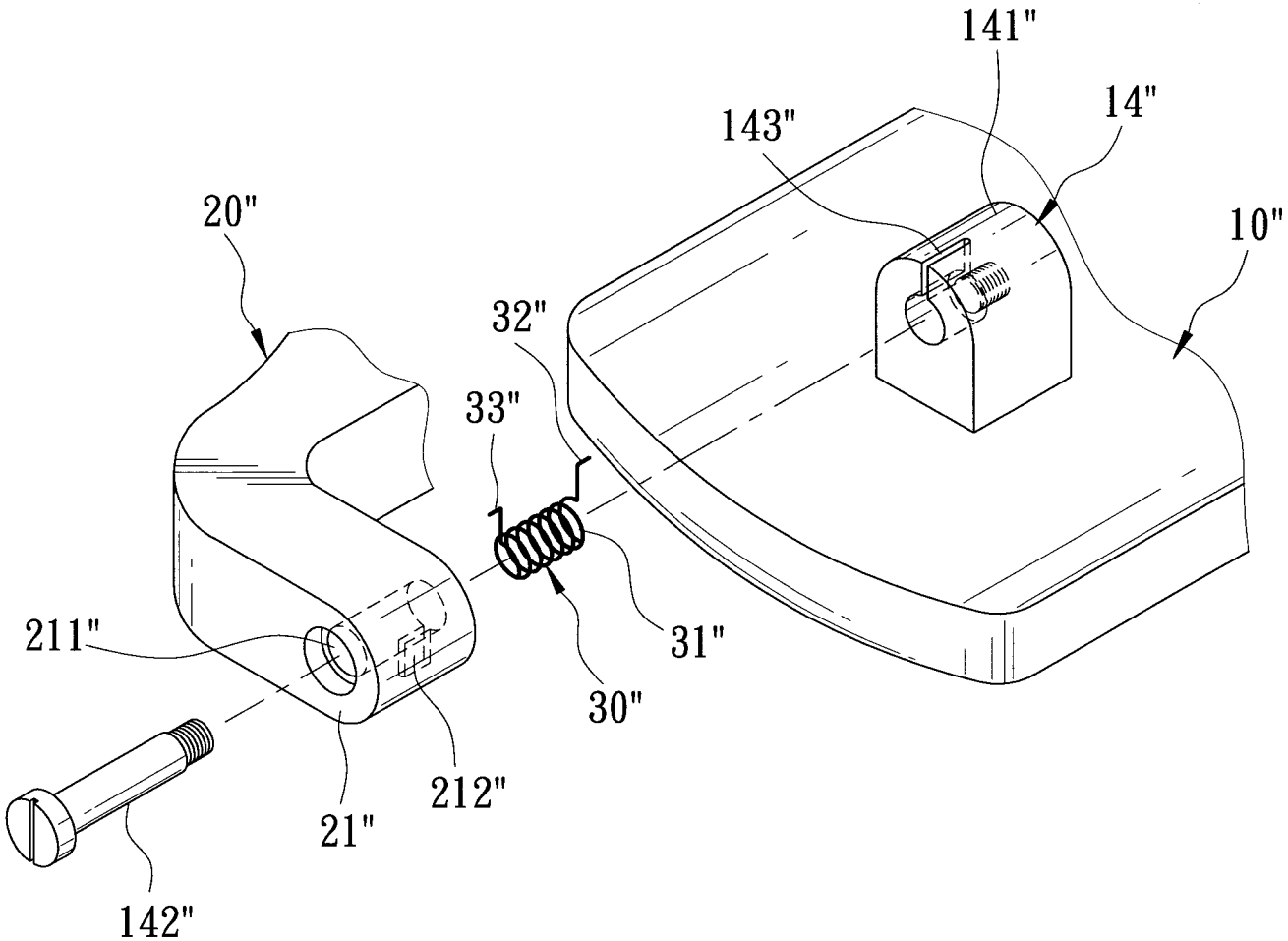
FIG. 6 is a fragmentary exploded perspective view of a third preferred embodiment of a brush having a resiliently articulated handgrip according to the present invention.

FIG. 6 illustrates a third preferred embodiment of the brush having a resiliently articulated handgrip according to the present invention. In this embodiment, the pivot connector 14" of the brushing unit 10" includes a pivot ear 141" and a pivot shaft 142" connected to the pivot ear 141", the pivot ear 141" being formed with a first engaging groove 143". The pivoted portion 21" of the handgrip 20" is formed with a pivot hole 211" through which the pivot shaft 142" is extended, the pivot hole 211" having a hole-defining wall that is formed with a second engaging groove 212". The resilient component 30" is a torsion spring that has a coiled portion 31" sleeved on the pivot shaft 142", a first spring end 32" extending from one end of the coiled portion 31" and being retained in the first engaging groove 143", and a second spring end 33" extending from another end of the coiled portion 31" and being retained in the second engaging groove 212". Use of the resilient component 30" for making resilient the connection of the handgrip 20" to the brushing unit 10" provides the same merits as in the previous embodiments.

Figure 7:
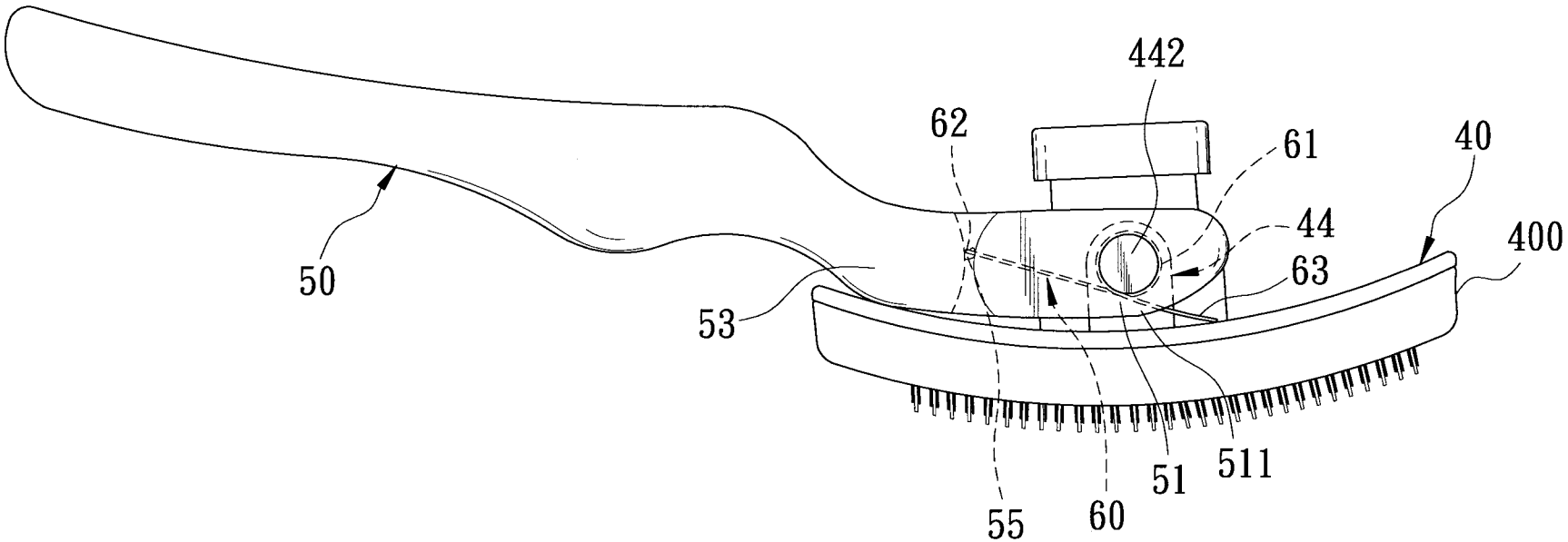
FIG. 7 is schematic diagram of a fourth preferred embodiment of a brush having a resiliently articulated handgrip according to the present invention.
Figure 8:
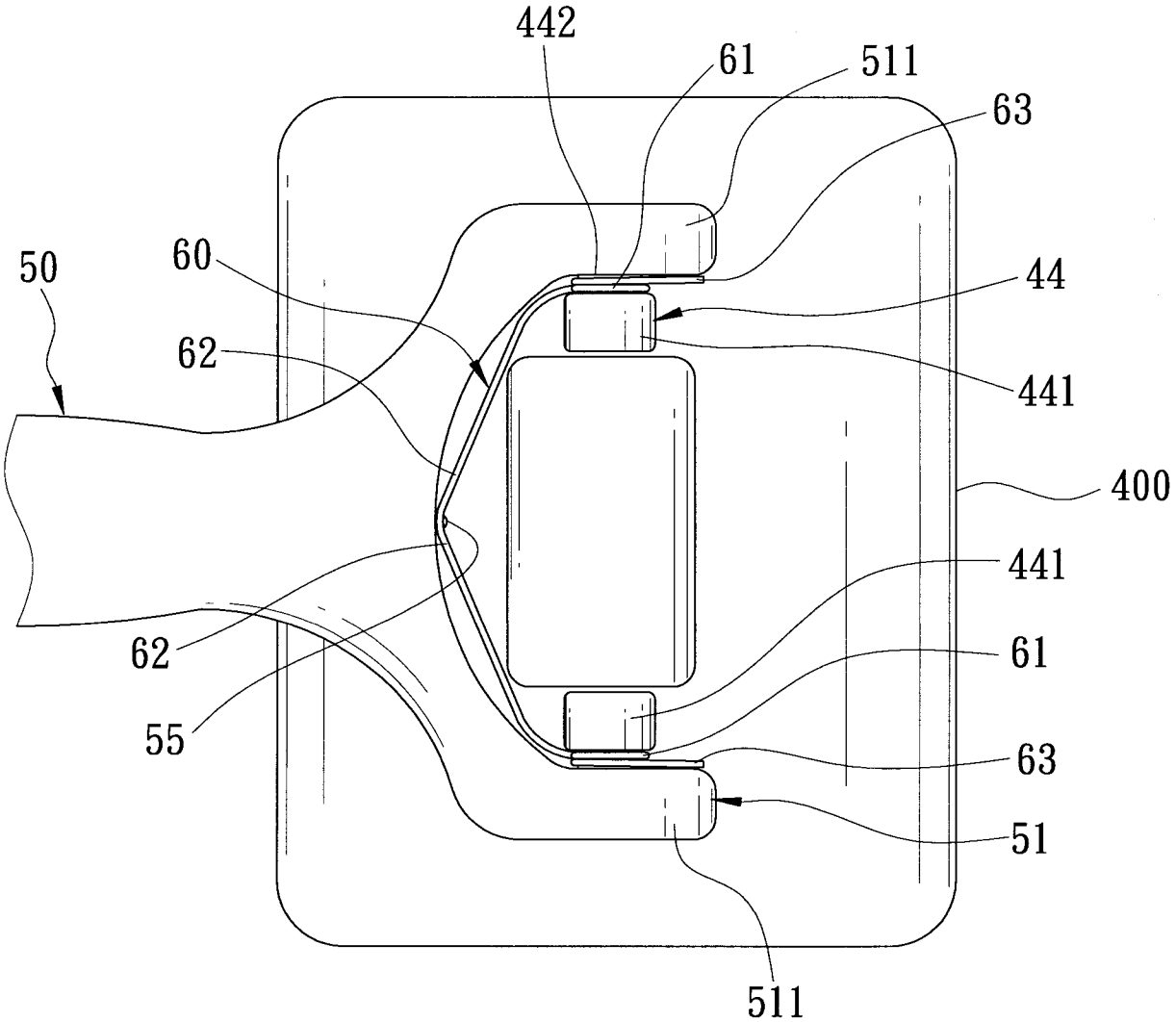
FIG. 8 is a fragmentary top view of the fourth preferred embodiment.

FIGS. 7 and 8 illustrate a fourth preferred embodiment of the brush having a resiliently articulated handgrip according to the present invention. In this embodiment, the pivot connector 44 of the brushing unit 40 includes two pivot ears 441, and two pivot shafts 442 connected respectively to the pivot ears 441. The pivoted portion 51 of the handgrip 50 has two pivot plates 511 pivoted to the pivot shafts 442, respectively. The resilient component 60 is a torsion spring having two coiled portions 61 sleeved respectively on the pivot shafts 442, two first spring ends 62 extending respectively from the coiled portions 61 and fastened to the handgrip 50, and two second spring ends 63 extending respectively from the coiled portions 61 and abutting against the bristle-retaining member 400. Preferably, the pivoted portion 51 further has a spring fastener 55 between the pivot plates 511 and proximate to the positioning portion 53, and the first spring ends 62 of the resilient component 60 are integrally connected and are fastened to the handgrip 50 at the spring fastener 55. Use of the resilient component 60 for making resilient the connection of the handgrip 50 to the brushing unit 40 provides the same merits as in the previous embodiments.

Figure 9:
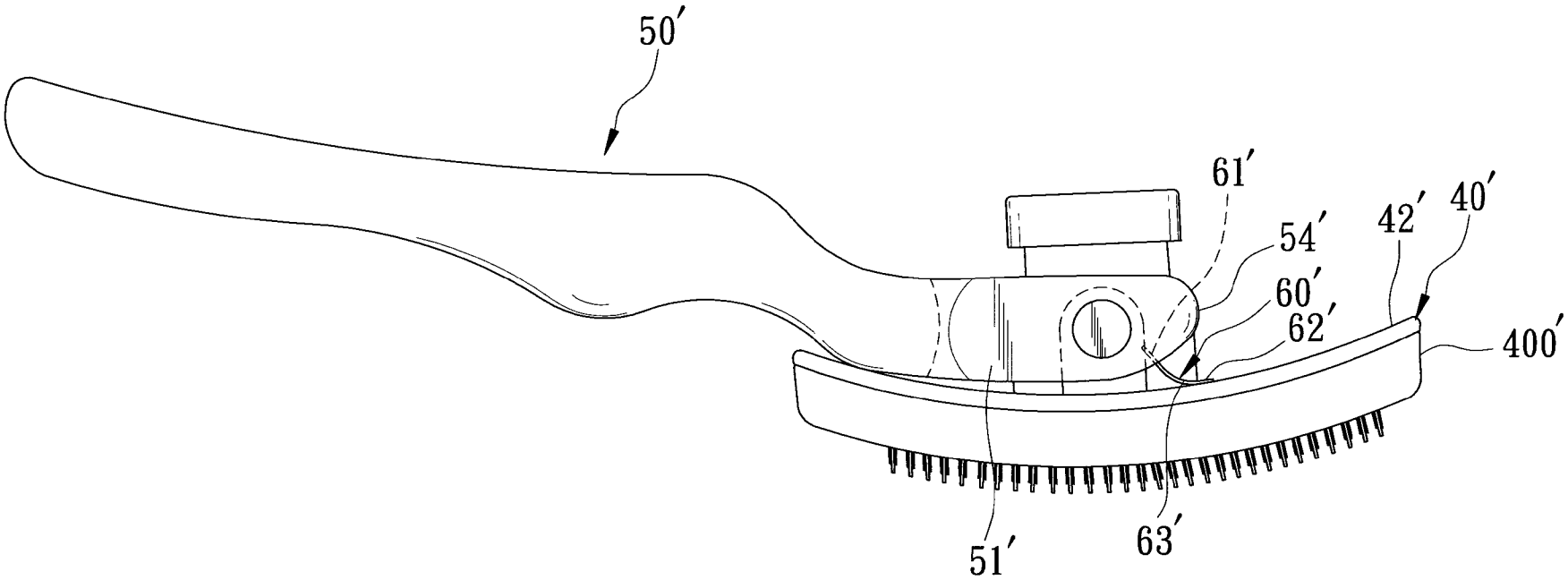
FIG. 9 is a schematic diagram of a fifth preferred embodiment a brush having a resiliently articulated handgrip according to the present invention.
Figure 10:
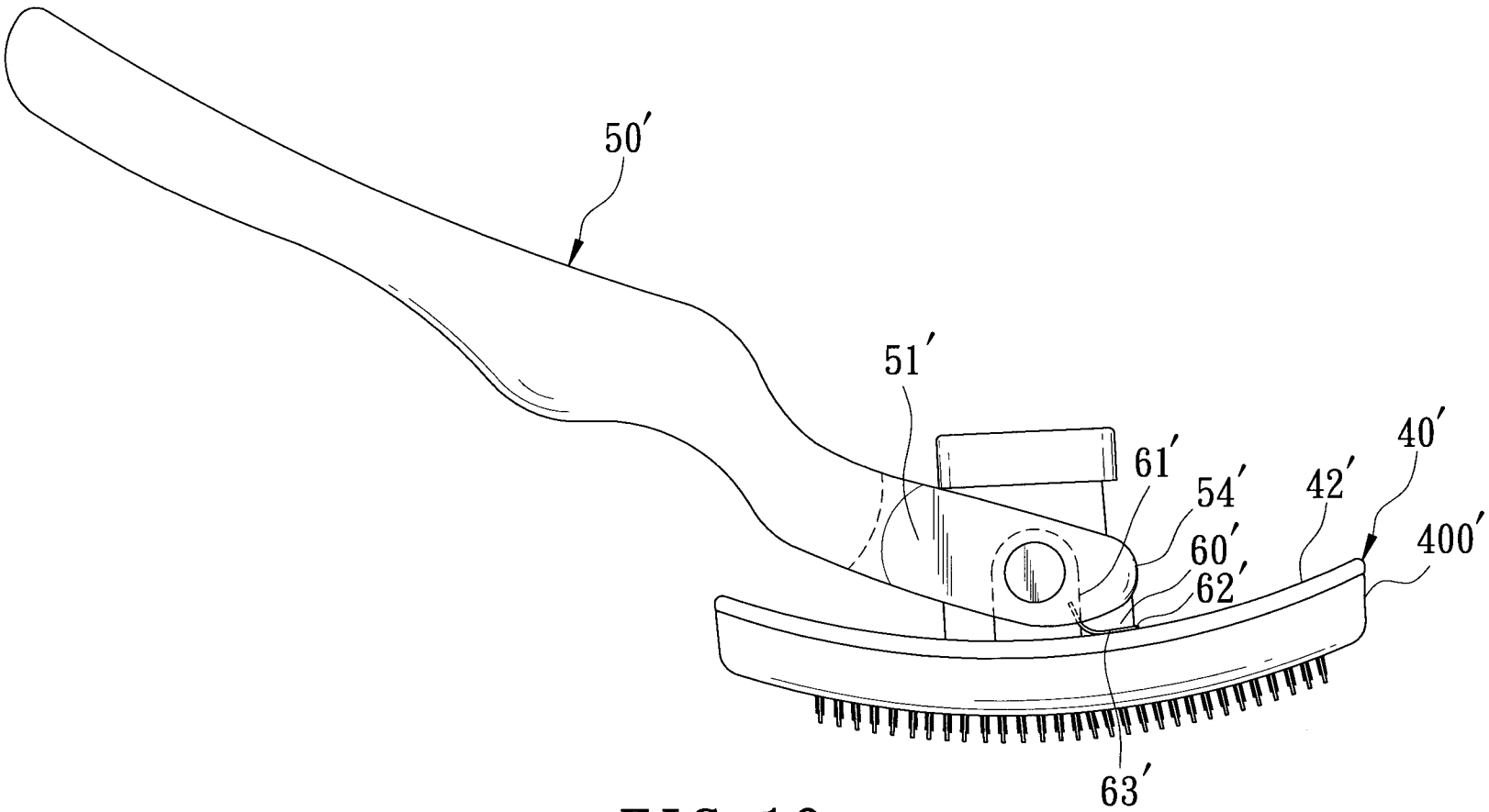
FIG. 10 is a schematic diagram to illustrate pivoting of a handgrip of the fifth preferred embodiment relative to a brushing unit thereof during operation.

FIGS. 9 and 10 illustrate a fifth preferred embodiment of the brush having a resiliently articulated handgrip according to the present invention. In this embodiment, the resilient component 60' is a spring plate that has a fastening portion 61' secured to the tip segment 54' of the pivoted portion 51' of the handgrip 50', an abutting portion 62' abutting against the second side 42' of the bristle-retaining member 400', and a curved portion 63' that interconnects the fastening portion 61' and the abutting portion 62' and that is depressed toward the second side 42' of the bristle-retaining member 400'. Use of the resilient component 60' for making resilient the connection of the handgrip 50' to the brushing unit 40' provides the same merits as in the previous embodiments.

Figure 11:
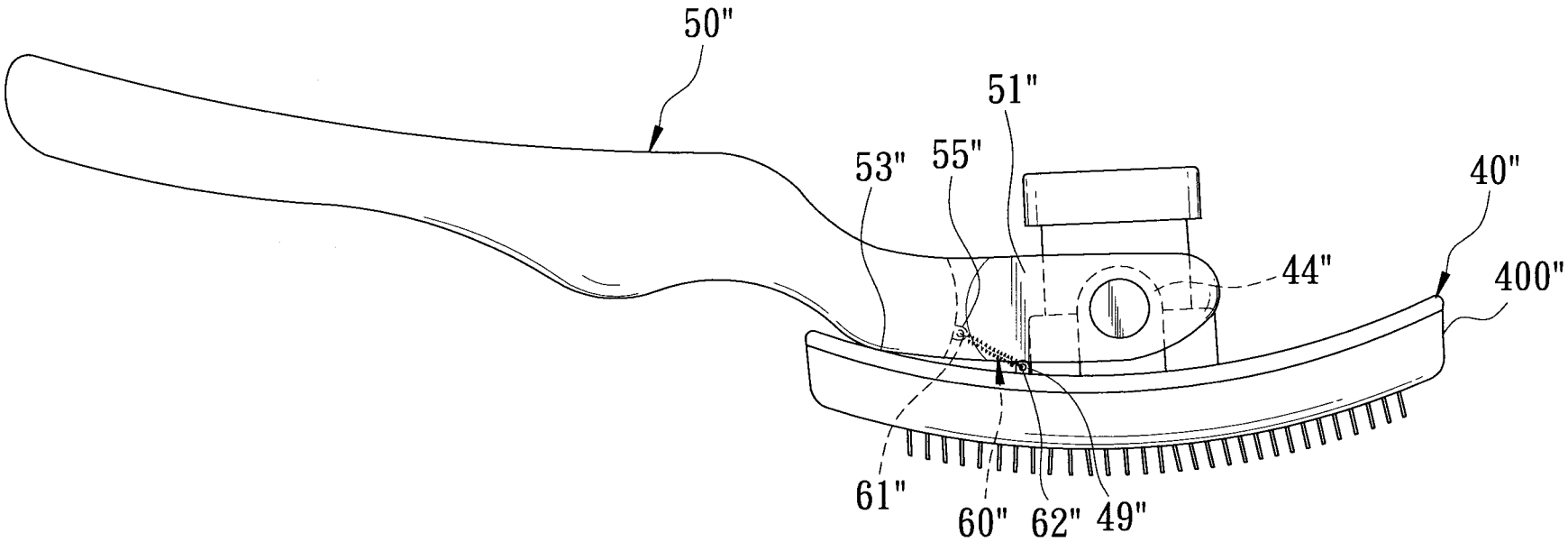
FIG. 11 is a schematic diagram of a sixth preferred embodiment a brush having a resiliently articulated handgrip according to the present invention.
Figure 12:
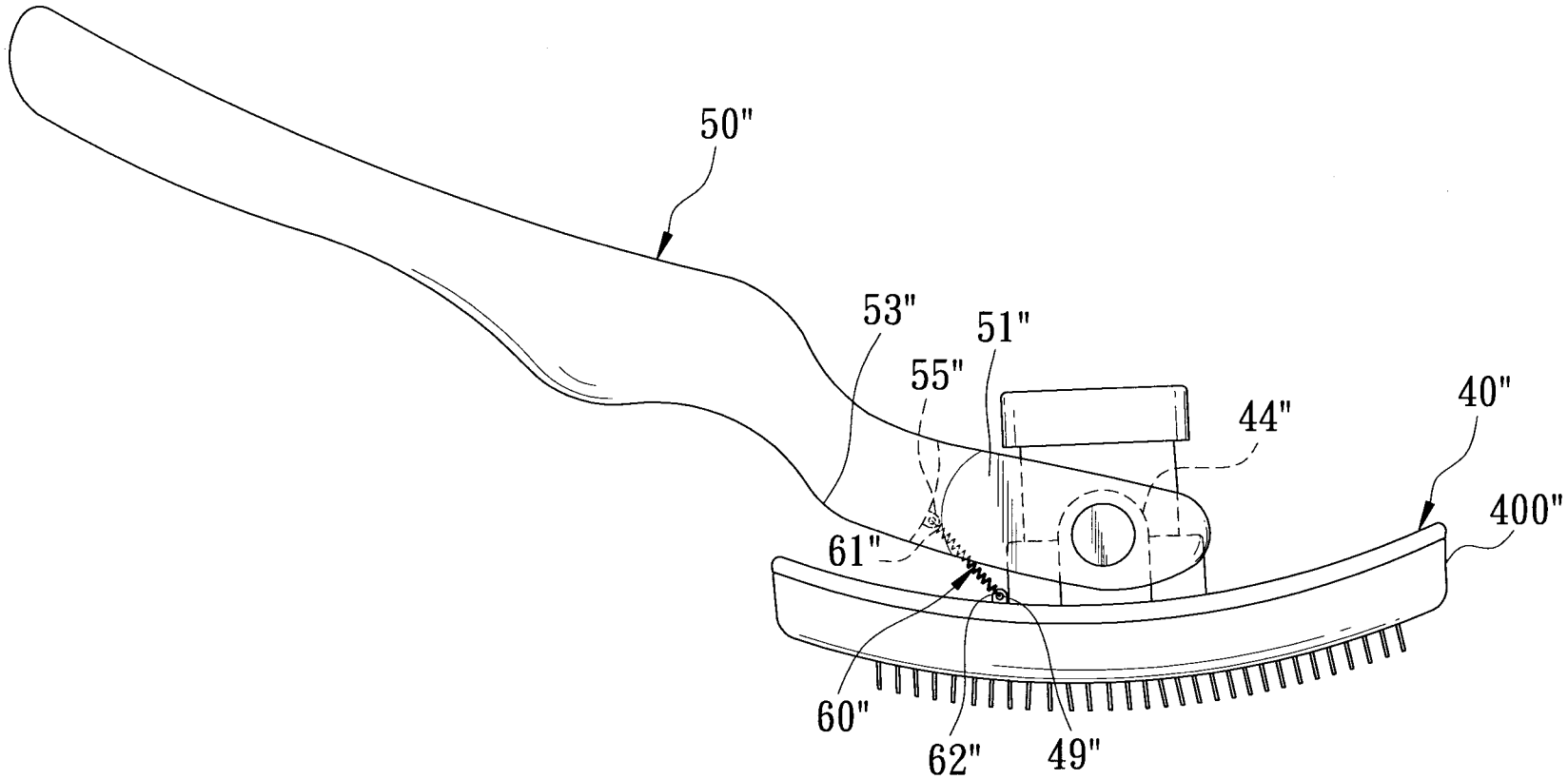
FIG. 12 is a schematic diagram to illustrate pivoting of a handgrip of the sixth preferred embodiment relative to a brushing unit thereof during operation.

FIGS. 11 and 12 illustrate a sixth preferred embodiment of the brush having a resiliently articulated handgrip according to the present invention. In this embodiment, the pivoted portion 51" of the handgrip 50" has a spring fastener 55" proximate to the positioning portion 53", and the resilient component 60" is an extension spring that has a first end portion 61" secured to the spring fastener 55" and a second end portion 62" secured to the bristle-retaining member 400" of the brushing unit 40". Preferably, the spring fastener 55" is a hook ear, the bristle-retaining member 400" of the brushing unit 40" has a hook ear 49" proximate to the pivot connector 44", and the first and second end portions 61", 62" of the resilient component 60" are hooks that engage respectively the hook ear 55" of the handgrip 50" and the hook ear 49" of the brushing unit 40". Use of the resilient component 60" for making resilient the connection of the handgrip 50" to the brushing unit 40" provides the same merits as in the previous embodiments.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A brush comprising:

a brushing unit including a bristle-retaining member that has a first side and a second side opposite to said first side, a plurality of bristles retained on said bristle-retaining member and disposed on said first side, and a pivot connector provided on said second side of said bristle-retaining member;

a handgrip having a pivoted portion that is pivotally connected to said pivot connector and that pivots about a pivot axis, a grip portion that is opposite to said pivoted portion, and a positioning portion that is disposed between said pivoted portion and said grip portion; and a resilient component disposed between said brushing unit and said handgrip, and providing a biasing force for urging said positioning portion of said handgrip to abut against said bristle-retaining member;

wherein an orthographic projection of said resilient component on to said bristle-retaining member is spaced apart from an orthographic projection of the pivot axis on said bristle-retaining member.

2. The brush as claimed in claim 1, wherein said pivoted portion of said handgrip has a tip segment distal from said positioning portion, and said resilient component is a compression spring disposed between and abutting resiliently against said second side of said bristle-retaining member and said tip segment.

3. The brush as claimed in claim 2, wherein said bristle-retaining member includes a bristle-retaining wall having said bristles retained thereat, a strand-removing wall movable toward and away from said bristle-retaining wall and formed with a plurality of bristle-extension apertures through which said bristles extend, and an operating member for driving movement of said strand-removing wall relative to said bristle-retaining wall.

4. The brush as claimed in claim 1, wherein:

said pivot connector includes a pivot ear and a pivot shaft connected to said pivot ear, said pivot ear being formed with a first engaging groove, said pivoted portion of said handgrip is formed with a pivot hole through which said pivot shaft is extended, said pivot hole having a hole-defining wall that is formed with a second engaging groove, and said resilient component is a torsion spring that has a coiled portion sleeved on said pivot shaft, a first spring end extending from one end of said coiled portion and being retained in said first engaging groove, and a second spring end extending from another end of said coiled portion and being retained in said second engaging groove.

5. The brush as claimed in claim 1, wherein:

said pivot connector includes two pivot ears, and two pivot shafts connected respectively to said pivot ears;

said pivoted portion of said handgrip has two pivot plates pivoted to said pivot shafts, respectively; and said resilient component is a torsion spring having two coiled portions sleeved respectively on said pivot shafts, two first spring ends extending respectively from said coiled portions and fastened to said handgrip, and two second spring ends extending respectively from said coiled portions and abutting against said bristle-retaining member.

6. The brush as claimed in claim 5, wherein said pivoted portion further has a spring fastener between said pivot plates, and said first spring ends of said resilient component are integrally connected and are fastened to said handgrip at said spring fastener.

7. The brush as claimed in claim 6, wherein said bristle-retaining member includes a bristle-retaining wall having said bristles retained thereat, a strand-removing wall movable toward and away from said bristle-retaining wall and formed with a plurality of bristle-extension apertures through which said bristles extend, and an operating member for driving movement of said strand-removing wall relative to said bristle-retaining wall.

8. The brush as claimed in claim 1, wherein said pivoted portion of said handgrip has a tip segment distal from said positioning portion, and said resilient component is a spring plate that has a fastening portion secured to said tip segment, an abutting portion abutting against said second side of said bristle-retaining member, and a curved portion that interconnects said fastening portion and said abutting portion and that is depressed toward said second side of said bristle-retaining member.

9. The brush as claimed in claim 8, wherein said bristle-retaining member includes a bristle-retaining wall having said bristles retained thereat, a strand-removing wall movable toward and away from said bristle-retaining wall and formed with a plurality of bristle-extension apertures through which said bristles extend, and an operating member for driving movement of said strand-removing wall relative to said bristle-retaining wall.

10. The brush as claimed in claim 1, wherein said pivoted portion of said handgrip has a spring fastener proximate to said positioning portion, and said resilient component is an extension spring that has a first end portion secured to said spring fastener and a second end portion secured to said bristle-retaining member.

11. The brush as claimed in claim 10, wherein said bristle-retaining member includes a bristle-retaining wall having said bristles retained thereat, a strand-removing wall movable toward and away from said bristle-retaining wall and formed with a plurality of bristle-extension apertures through which said bristles extend, and an operating member for driving movement of said strand-removing wall relative to said bristle-retaining wall.

* * * * *